United States Patent [19]

Parson et al.

[11] Patent Number: 4,465,314

[45] Date of Patent: Aug. 14, 1984

[54] MATERIAL HANDLING APPARATUS

[76] Inventors: Mark E. Parson; Rodney L. Parson, both of 9733 S. Menard, Oak Lawn, Ill. 60453

[21] Appl. No.: 334,302

[22] Filed: Dec. 24, 1981

[51] Int. Cl.[3] ..... B66C 1/16

[52] U.S. Cl. ..... 294/81 R; 294/67 R

[58] Field of Search ..... 294/67 R, 67 B, 67 BA, 294/67 BB, 67 DC, 74, 78 R, 78 A, 81 R, 86 R, 86 LS; 414/758, 759, 771, 783; 269/70

[56] References Cited

U.S. PATENT DOCUMENTS

| | | | |
|---|---|---|---|
| 1,774,623 | 9/1930 | Williams | 294/81 R |
| 2,337,178 | 12/1943 | Breslav | 294/86 R |
| 2,656,051 | 10/1953 | Jenkins | 414/758 |
| 2,860,002 | 11/1958 | Herbst | 294/81 |
| 2,966,380 | 12/1960 | Swenson | 294/67 |
| 3,161,431 | 12/1964 | Francis | 294/63 |
| 3,197,249 | 7/1965 | Garman | 294/81 |
| 3,253,851 | 5/1966 | Gilbert | 294/67 |
| 3,297,353 | 1/1967 | Carlson | 294/81 |
| 3,456,976 | 7/1969 | Husmann | 294/74 |
| 3,927,909 | 12/1975 | Hack | 294/81 R |
| 4,111,310 | 9/1978 | Stobb | 294/86 R X |

FOREIGN PATENT DOCUMENTS

| | | | |
|---|---|---|---|
| 2301571 | 8/1973 | Fed. Rep. of Germany | 294/81 R |
| 412112 | 10/1974 | U.S.S.R. | 294/81 R |
| 485946 | 1/1976 | U.S.S.R. | 294/81 R |

*Primary Examiner*—Johnny D. Cherry

[57] ABSTRACT

A material handling apparatus for handling and precisely positioning a workpiece which includes two clamping elements capable of being fixedly clamped to opposite flanged sides of the workpiece. The clamping elements are rotatably attached to the remainder of the apparatus in a manner which permits rotation of the workpiece about both horizontal and vertical axes. The workpiece may be fixed in a multiple of desired positions and freely rotated after release from fixed positions.

13 Claims, 4 Drawing Figures

MATERIAL HANDLING APPARATUS

BACKGROUND OF THE INVENTION

There are today many manufacturing processes which require operations such as bending, machining, drilling, painting, etc. to be performed on heavy workpieces such as steel plates, structured channels, beams and the like. Often, the workpiece must be placed in a specific precise position for each operation to be performed, necessitating the workpiece to be turned while suspended in a variety of directions about horizontal and vertical axis. Since these workpieces are too heavy to be supported by human strength while being manipulated, apparatuses have been devised to provide the necessary support and at the same time enable such manipulation. Examples of such apparatuses are in the immediately following discussion.

U.S. Pat. No. 2,860,002 to Herbst discloses a hoisting apparatus which attaches to the workpiece, i.e. a die set, to be supported via lifting plates having keyhole slots therein which engage with mating studs which are integral parts of the workpiece. The device of Herbst would be useless for any workpiece that does not possess the necessary mating studs. Furthermore, the device of Herbst does not enable locking the workpiece in a fixed position with respect to the horizontal, nor does it suggest rotation about a vertical axis.

U.S. Pat. No. 3,161,431 to Francis discloses a device for carrying bricks which features a rotating platform for the bricks permanently attached to a frame which supports the platform. The device of Francis is not designed for work to be performed on the rotating platform itself, nor could the device be so used, except for the one platform in the original construction, in view of the permanent attachment. The device of Francis, therefore, is not relevant to the manipulation of heavy workpieces.

Other references even less relevant to the present invention, but mentioned herein to further set forth the extent of the prior art are the following: U.S. Pat. No. 2,966,380 to Swenson; U.S. Pat. No. 3,197,249 to Garman; U.S. Pat. No. 3,253,851 to Gilbert; U.S. Pat. No. 3,297,353 to Carlson; U.S. Pat. No. 3,456,976 to Husmann; and U.S. Pat. No. 3,927,909 to Hack.

In contradistinction to the devices of the prior art, the present invention comprises a unique apparatus which may easily be attached or detached from a workpiece, with the workpiece not requiring parts the sole purpose of which are to mate with the apparatus, and which enables the workpiece to be handled and turned over or rotated until all work is completed thereon.

SUMMARY OF THE INVENTION

Accordingly, the present invention comprises in one embodiment a material handling apparatus for handling and precisely positioning a workpiece, at least two opposite sides of the workpiece comprising flanges, the apparatus comprising: (a) two clamping means, each capable of being fixedly and detachably clamped to the flanges on at least two of the opposite sides of the workpiece; (b) a clamping means supporter rotatably attached to each of the clamping means which permits rotation of the clamping means about a horizontal axis; (c) a tensile member attached from above to each clamping means supporter at one end of the tensile member; (d) a rigid elongated separating member to which each tensile member is attached at the end of the tensile member opposite the end attached to the clamping means supporter, the separating member being of sufficient length to effect sufficient separation of the tensile members to preclude contact of the tensile members with the workpiece when the workpiece is rotated about a horizontal axis while clamped to the clamping means; and (e) a support structure supporting the separating member and attached to the separating member in a manner which enables the fixing of a desired relationship of the separating member to the horizontal.

Other embodiments of the present invention include details of construction of the device and the means by which it attaches to the workpiece, all of which are set forth in the following detailed discussion.

DETAILED DISCUSSION

Figure 1:
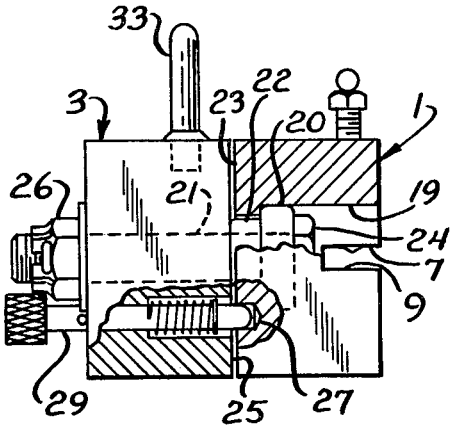
FIG. 1 provides a side partial sectional view of one of the clamping means and clamping means supporter assemblies of the apparatus of the present invention.
Figure 2:
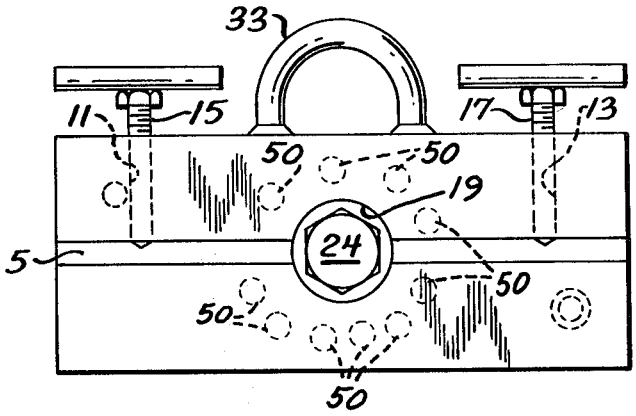
FIG. 2 is a frontal view of the device shown in FIG. 1.

With reference to FIGS. 1 and 2 which show a preferred embodiment of the clamping means and clamping means supporter assembly of the device of the present invention, each clamping means 1 is rotatably attached to a clamping means supporter 3 in a manner which permits rotation of the clamping means about a horizontal axis. Each of the two clamping means must be capable of being fixedly clamped to opposite sides of a workpiece. Preferably, each such side will comprise a flange to which a clamping means may be clamped.

Figure 3:
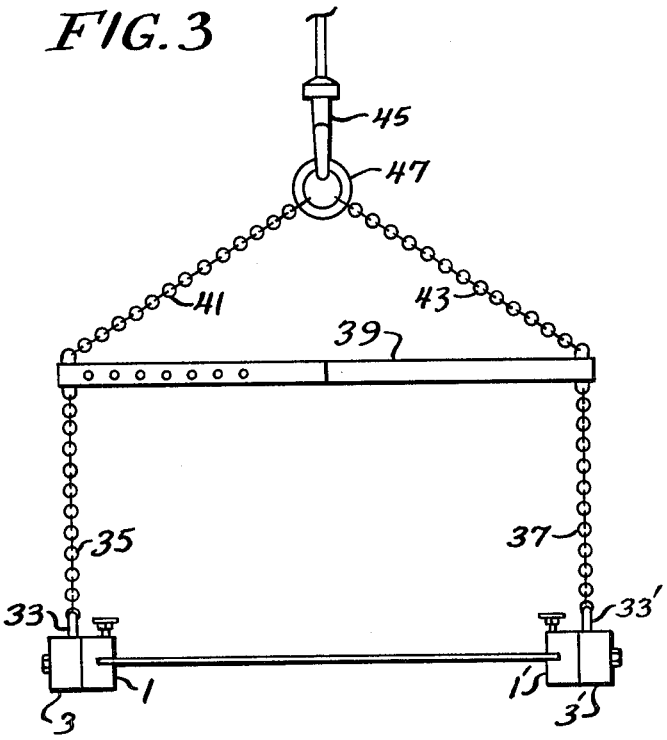
FIG. 3 is a frontal view of the complete apparatus of the present invention shown grasping a workpiece.

A preferred construction for clamping means 1 includes a slot 5 defined by parallel planes 7 and 9 which extends into the clamping means and which is of sufficient height and depth to permit insertion of a flange of the workpiece therein as shown in FIG. 3 and engagement of the flange in the slot. Each clamping means has threaded holes 11 and 13 therein which open into slot 5 through plane 7. The fixed clamping is effected by threaded shafts 15 and 17 each of which engages one of the threaded holes, one end of each threaded shaft coming into forcible contact with the flange as the threaded shaft is rotated in its respective threaded hole. In a preferred embodiment, the longitudinal axis of each threaded shaft is perpendicular to parallel planes 7 and 9. In a still more preferred embodiment, the ends of threaded shafts 15 and 17 opposite the ends in contact with the flanges extend beyond clamping means 1 and have attached to them handles as shown to enable forcible turning of the shafts by hand.

Thus, the apparatus of the present invention in contradistinction to the device of the aforementioned U.S. Pat. No. 2,860,002 to Herbst, is capable of attachment to any workpiece, particularly sheet steel, that has an edge or flange capable of fitting into slot 5, and, unlike the device of U.S. Pat. No. 3,161,431 to Francis, achieves easy attachment to or detachment from the workpiece.

With further reference to FIGS. 1 and 2, clamping means 1 has socket 19 contained therein and clamping means supporter 3 has shaft 21 therethrough. Shaft 21 may function as a spindle attached to clamping means supporter 3 and be journaled with respect to socket 19 in a manner which permits rotation of shaft 21 in socket 19 and thereby rotation of clamping means 1 about clamping means supporter 3, but which precludes relative movement between clamping means 1 and clamping means supporter 3 along the longitudinal axis of shaft 21. It is preferred to have low friction bearing means such as ball or roller bearings, to facilitate such rotation. FIGS. 1 and 2 illustrate a preferred configuration of such bearing means including ball bearing 20 having an inner and outer race and attached flange 22. Flange 22 is fixedly attached to the inner race of bearing 20 and also may be fixed with relation to shaft 21, e.g. by means of set screws. Shaft 21 will ideally comprise a threaded bolt, with head 24 and nut 26. Head 24 will contact the inner race of bearing 20 and thereby, as nut 26 is tightened, hold bearing 20 against clamping means supporter 3 via the inner race and flange 22. The outer race of bearing 20 will be in contact with and support clamping means 1, but, of course, neither the inner race nor flange 22 will be in contact with clamping means 1.

FIG. 1 illustrates means to prevent rotative movement of clamping means 1 with respect to clamping means supporter 3 so as to enable the workpiece to be fixed in a desired position. Clamping means 1 and clamping means supporter 3 have adjacent surfaces 23 and 25, respectively, with surface 23 having a detent 27 contained therein. Clamping means supporter 3 has a pawl 29 integral therewith and slidable along the longitudinal axis of the pawl. Pawl 29 passes through surface 25 to detachably engage detent 27, thereby preventing rotative movement of clamping means 1 with respect to clamping means supporter 3. Ideally, pawl 29 will be spring loaded in a manner effecting it to be forcibly engaged with detent 27. The end of pawl 29 opposite the end in detent 27 should protrude from clamping means supporter 3 to enable the grasping of pawl 29 at the protruding end by hand and the pulling of pawl 29 from detent 27 against the force of the spring, thereby enabling clamping means 1 to rotate freely with respect to clamping means supporter 3. Surface 23 may have a multiplicity of detents 50, each of which is able to engage pawl 29 at an appropriate position of rotation of clamping means 1 with respect to clamping means supporter 3, thereby enabling the workpiece to be fixedly positioned at any one of a multiplicity of positions of rotation.

Figure 4:
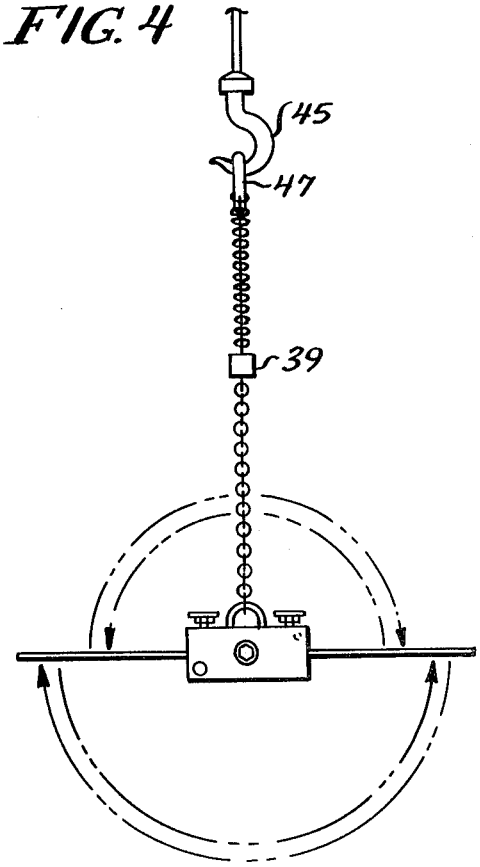
FIG. 4 is a side view of the apparatus and workpiece shown in FIG. 3 with circular arrows indicating rotation of the workpiece about a horizontal axis.

The preferred means for attaching each clamping means supporter to the rest of the device via the tensile members is U-shaped lug 33 which attaches to the upper surface of each of the clamping means supporters at the ends of the legs of the lug. Referring now to FIGS. 3 and 4, there is shown the device of the present invention in its entirety, including tensile members 35 and 37, elongated separating member 39, second tensile members 41 and 43 and primary supporting means 45. Tensile members 35 and 37 attach to lugs 33 and 33' respectively, and thereby to the clamping means supporters, to effect the support of the clamping means and clamping means supporter assemblies. It is preferred that the tensile members be flexible, ideally comprising chains.

With reference to FIG. 3, it is shown how separating member 39 separates tensile members 35 and 37. Separating member 39 is in longitudinal compression, and, of course, it is necessary that member 39 be capable of withstanding such compression. Ideally, separating member 39 should be capable of adjustment in length so as to separate tensile members 35 and 37 to the required extent depending on the size and dimensions of the workpiece then being handled by the apparatus. Perhaps the best way of achieving this adjustment capability is for member 39 to comprise at least two sections, one telescoping inside the other, the extent of such telescoping depending on the desired length of member 39, there being means for fixedly maintaining the extent of telescoping, such as a bolt or peg passing through holes in the telescoping sections.

FIGS. 3 and 4 also illustrate the support structure of the apparatus of the present invention. The support structure will typically comprise second tensile members 41 and 43 which connect at one end to separating member 39 and at the other end to primary supporting means 45. Primary supporting means 45 would most conveniently comprise a hook, as shown, which detachably engages O-ring 47, with the ends of second tensile members 41 and 43 opposite separating member 39 being attached to O-ring 47, thereby effecting the attachment of the second tensile members to the primary supporting means. It is highly advantageous for primary supporting means 45 to be capable of rotation about a vertical axis, thereby enabling the workpiece to be rotated about a vertical axis.

We claim:

1. A material handling apparatus for handling and precisely positioning a workpiece, at least two opposite sides of which comprise flanges, said apparatus comprising:

(a) two clamping means, each capable of being fixedly and detachably clamped to said flanges on at least two of said opposite sides of said workpiece, each of said clamping means having a slot therein defined by parallel planes, each said flange engaging one of said slots, each of said clamping means having a threaded hole therein which opens into said slot through one of said parallel planes;

(b) threaded shafts which engage said threaded holes in each of said clamping means, one end of said threaded shafts coming into forcible contact with said flanges as said threaded shafts are rotated in said threaded holes, thereby effecting said fixed clamping;

(c) a clamping means supporter rotatably attached to each of said clamping means which permits rotation of said clamping means about a horizontal axis, each of said clamping means and associated clamping means supporter having adjacent surfaces, said adjacent surface of said clamping means having a multiplicity of detents contained therein, each of such detents able to engage a pawl to prohibit the relative rotatability of said workpiece about said horizontal axis;

(d) a spring loaded pawl integral with each clamping means supporter and slidable along the longitudinal axis of said pawl, one end of said pawl passing through said adjacent surface of said clamping means supporter to detachably engage one of said multiplicity of said detents associated with said clamping means to prevent rotative movement of said clamping means with respect to said clamping means supporter and enabling said workpiece to be fixed in a desired position and the opposite end of said pawl protruding from said clamping means supporter possessing a gripping member to enable grasping of said pawl at said protruding end and thereby the pulling of said pawl from said one of a multiplicity of detents against the force of the spring to enable removal of said pawl from clamping means and to thereby provide free rotation of said clamp means with respect to said clamping means supporter;

(e) a tensile member attached from above to each clamping means supporter at one end of said tensile member;

(f) a rigid elongated separating member to which each tensile member is attached at the end of said tensile member opposite the end attached to said clamping means supporter, said separating member being of sufficient length to effect sufficient separation of said tensile members to preclude contact of said tensile members with said workpiece when said workpiece is rotated about a horizontal axis while clamped to said clamping means;

(g) a support structure supporting said separating member and attached to said separating member in a manner which enables the fixing of a desired relationship of said separating member to the horizontal.

2. The apparatus of claim 1 wherein a U-shaped lug is attached to the upper surface of each of said clamping means supporters at the ends of the legs of said lug, said tensile member being attached to said lug and thereby to said clamping means supporter.

3. The apparatus of claim 1 wherein said tensile members are flexible.

4. The apparatus of claim 3 wherein said tensile members comprise chains.

5. The apparatus of claim 1 wherein said elongated separating member is capable of adjustment in length so as to separate the tensile members to the required extent depending on the size and dimensions of the workpiece then being handled by said apparatus.

6. The apparatus of claim 5 wherein said separating member comprises at least two sections, one telescoping inside the other, the extent of said telescoping depending on the desired length of said separating member, there being means for fixedly maintaining said extent of telescoping.

7. The apparatus of claim 1 wherein said support structure comprises a primary supporting means and two second tensile members, one end of each said second tensile member being attached to said separating member and the opposite end of each said second tensile member being attached to said primary supporting means.

8. The apparatus of claim 7 wherein said primary supporting means comprises a hook, which detachably engages an O-ring, the end of each said second tensile members opposite said separating member being attached to said O-ring, thereby effecting said attachment of said second tensile members to said primary supporting means.

9. The apparatus of claims 7 or 8 wherein said primary supporting means is capable of rotation about a vertical axis, thereby enabling said workpiece to be rotated about a vertical axis.

10. The apparatus of claim 1 wherein the longitudinal axis of said threaded shaft is perpendicular to the parallel planes which define said slot.

11. The apparatus of claim 1 wherein the ends of said threaded shafts opposite said ends in contact with said flanges extend beyond said clamping means and have attached thereto handle means to enable forcible turning of said shaft by hand.

12. The apparatus of claim 1 wherein said clamping means has a socket contained therein and said clamping means supporter has a spindle attached thereto, said spindle being journaled with respect to said socket in a manner which permits rotation of said spindle in said socket and thereby said clamping means about said clamping means supporter, but which precludes relative movement between said clamping means and clamping means supporter along the longitudinal axis of said spindle.

13. The apparatus of claim 12 wherein low friction bearing means are between the bearing surfaces of said spindle and said socket.

* * * * *